United States Patent [19]

Higa

[11] 4,449,894

[45] May 22, 1984

[54] CENTRIFUGAL-RECIPROCATING COMPRESSOR

[75] Inventor: Walter H. Higa, Kaneohe, Hi.

[73] Assignee: The United States of America as represented by the Administrator of the National Aeronautics and Space Administration, Washington, D.C.

[21] Appl. No.: 401,288

[22] Filed: Jul. 23, 1982

Related U.S. Application Data

[63] Continuation-in-part of Ser. No. 037,194, May 8, 1979.

[51] Int. Cl.[3] ..... F04B 17/00; F04B 17/02

[52] U.S. Cl. ..... 417/328; 417/392; 417/462

[58] Field of Search ..... 417/211, 240, 241, 328, 417/392, 462

[56] References Cited

U.S. PATENT DOCUMENTS

| | | | |
|---|---|---|---|
| 901,344 | 10/1908 | Horstmann | 417/328 |
| 1,370,305 | 3/1921 | Golle | 417/462 |
| 1,857,720 | 5/1932 | Gerling | 417/328 X |
| 3,941,515 | 3/1976 | Austin | 417/240 |

*Primary Examiner*—Richard E. Gluck

*Attorney, Agent, or Firm*—John R. Manning; Paul F. McCaul; Thomas H. Jones

[57] ABSTRACT

A centrifugal compressor (50) includes at least one pair of cylinders (56 and 58) arranged in coaxial alignment and supported for angular displacement about a common axis of rotation (84) normally bisecting a common longitudinal axis of symmetry for the cylinders. The cylinders are characterized by ported closures (64 and 66) located at the mutually remote ends thereof through which the cylinders are charged and discharged, and a pair of piston heads (68 and 70) seated within the cylinders and supported for floating displacement in compressive strokes in response to unidirectional angular displacement imparted to the cylinders.

17 Claims, 9 Drawing Figures

Fig. 1
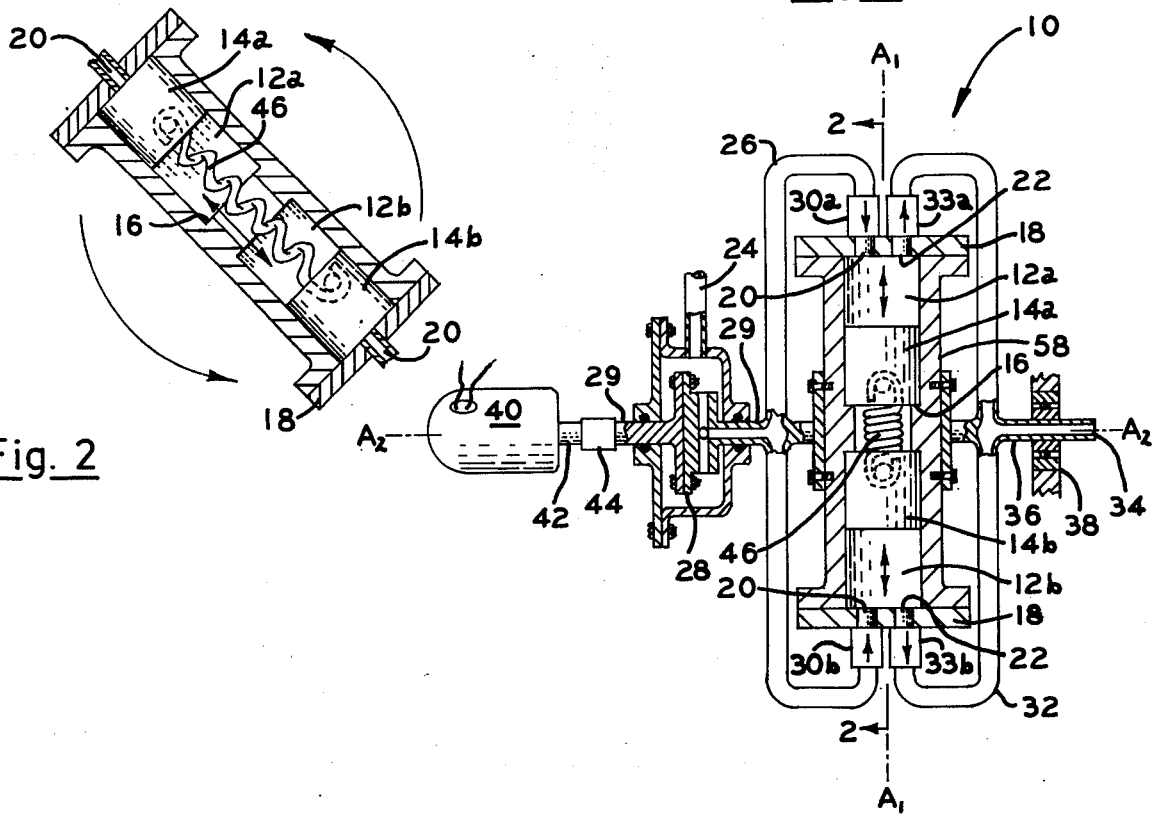
Fig. 2
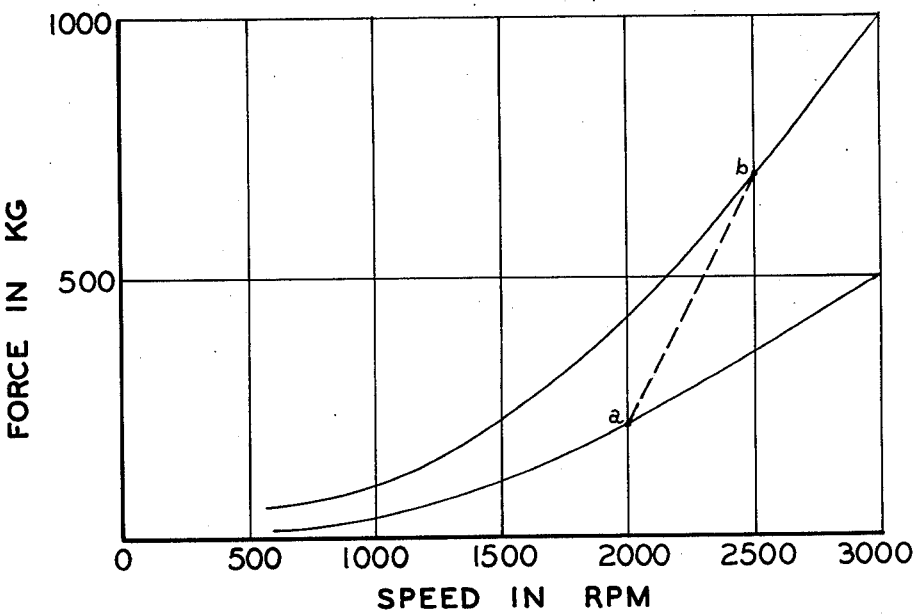
Fig. 3

CENTRIFUGAL-RECIPROCATING COMPRESSOR

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

CROSS-REFERENCE TO RELATED APPLICATIONS

This application is a continuation-in-part application of application Ser. No. 037,194, filed on May 8, 1979.

BACKGROUND OF THE INVENTION

1. Field of the Invention

The invention generally relates to high performance compressors for use in cryogenic systems and more particularly to a centrifugal compressor characterized by pistons seated in coaxially aligned, rotatable cylinders and driven in compressive strokes as angular displacement is imparted to the cylinders.

2. Description of the Prior Art

Reciprocating compressors generally are well known. Such devices usually include at least one cylinder having a pivoted head mounted therein and connected to a crankshaft through a piston rod or the like. The cylinder, in most instances, is provided with a ported head including an inlet valve and an exhaust valve which permits the cylinder to charge as the piston head is retracted, and to discharge or expel the charge in response to an extension of the piston head as the piston head is extended relative to the cylinder in response to rotation of the crankshaft.

Numerous difficulties frequently are encountered when employing reciprocating compressors of the type generally aforedescribed. One such difficulty sometimes experienced is that in order to establish a desirable flow rate of working fluid, a relatively large piston-cylinder combination is required. The resulting structure frequently requires a driving force of a substantial magnitude which, in turn, necessitates a use of a heavy and rugged connecting rod, crankshafts and the like. The problem is further compounded where large reduction gears and heavy fly wheels are required to supply the relatively large torque required in driving the heavy structure.

Of course, numerous techniques have been suggested in order to alleviate the various problems aforementioned. However, in most instances, the techniques relied upon generally constitute no more than compromises and trade-offs. Therefore, improvements in certain aspects of conventional compressors are achieved only at the expense of other aspects.

It is therefore the general purpose of the instant invention to provide an improved compressor through use of which improved efficiency, a reduction of weight and bulk, and increased reliability are realized.

OBJECTS AND SUMMARY OF THE INVENTION

It is an object of the instant invention to provide an improved compressor.

It is another object to provide an improved compressor having particular utility in combination with cryogenic systems employed aboard spacecraft.

It is another object to provide a centrifugal-reciprocating compressor adapted to utilize centrifugal forces for compressing fluids within cylinders.

It is another object to provide an improved centrifugal compressor comprising a pair of floating pistons supported within rotating cylinders adapted to be displaced on compression strokes as the cylinders are angularly displaced.

It is another object to provide a compressor for fluids comprising a rotatable housing including a pair of opposed cylinders having disposed therein pistons supported for radial acceleration against bodies of fluid confined in the cylinders, as rotation is imparted to the housing, and means for retracting the piston heads for charging the cylinders with bodies of fluid.

Another object is to provide a centrifugal compressor which is particularly useful in connection with cryogenic systems aboard spacecraft and the like, although not necessarily restricted in use thereto since the compressor may be equally useful when installed in pumping systems employed in terrestrial environments.

These together with other objects and advantages are achieved through the use of a rotatable housing characterized by at least one pair of cylinders arranged in coaxial alignment and characterized by a pair of mutually remote ends having ported closures and a common longitudinal axis of symmetry extended between the remote ends of the cylinders, means supporting the pair of cylinders for rotation about a common axis normally bisecting the longitudinal axis of symmetry, a pair of floating piston heads disposed within the cylinders and supported thereby for rectilinear displacement, drive means for imparting angular displacement to the housing, whereby the piston heads are forced outwardly on fluid compressive strokes, and means for retracting the piston heads for imparting thereto fluid intake strokes, all as will become more readily apparent by reference to the following description and claims in light of the accompanying drawings.

BRIEF DESCRIPTION OF THE DRAWINGS

FIG. 1 is a fragmented, partially sectioned view of one embodiment of the instant invention having a pair of rotatable cylinders within which there is seated a pair of pistons in retracted configurations.

FIG. 2 is a cross sectional view taken generally along lines 2—2 of FIG. 1, with the cylinders being rotated through approximately 30° of angular displacement relative to the position assumed in FIG. 1.

FIG. 3 is a graphic view depicting the centrifugal forces developed for a specific compressor, illustrating utility of the invention.

DESCRIPTION OF THE PREFERRED EMBODIMENTS

Figure 4:
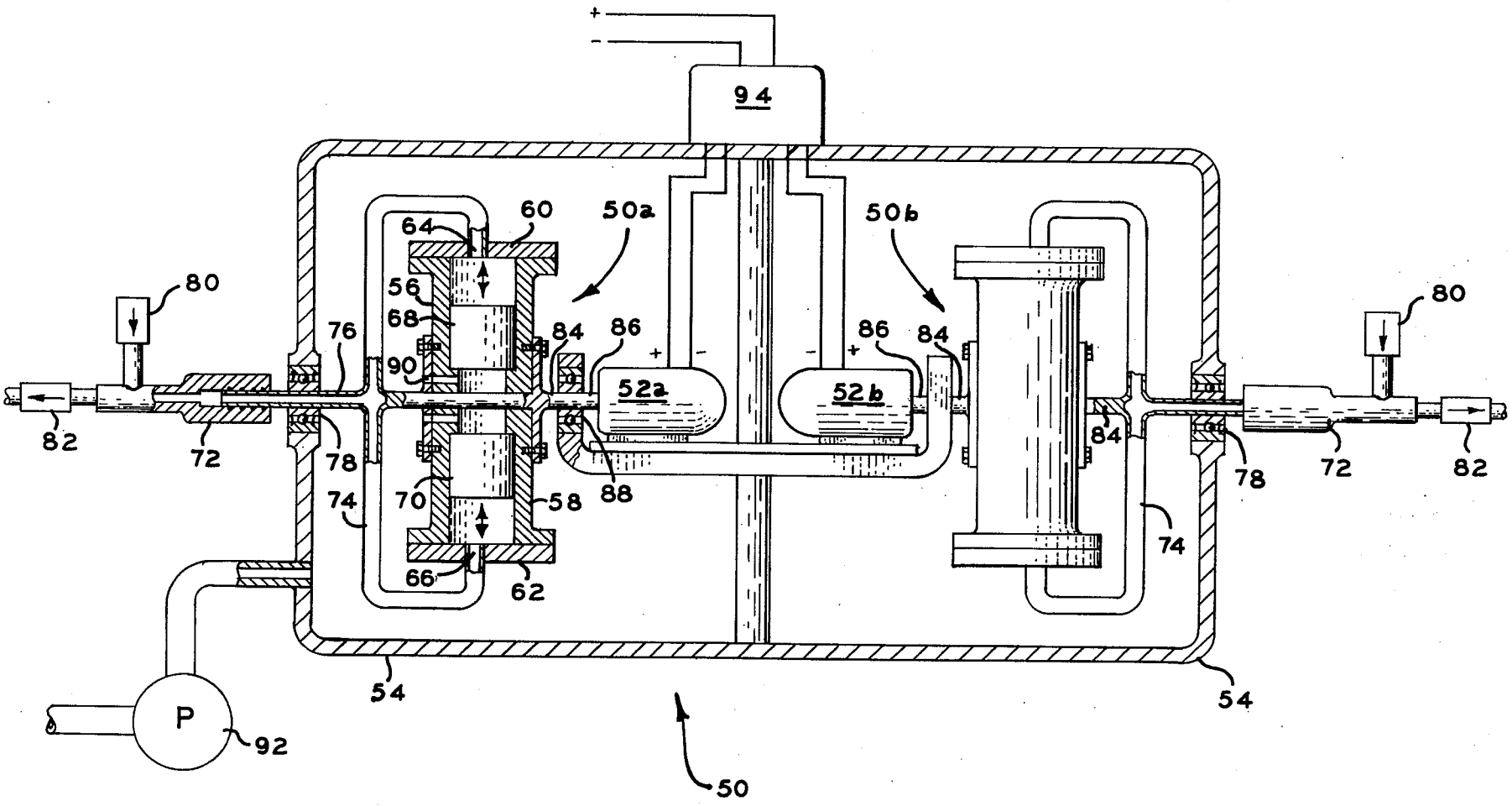
FIG. 4 is a cross sectional view illustrating a further embodiment of the instant invention.

Referring now to the drawings with more particularity wherein like reference characters designate like or corresponding parts throughout the several views, there is shown in FIG. 1 first compressor, generally designated 10, embodying the principles of the instant invention.

The compressor 10 includes a pair of cylinders, designated 12*a* and 12*b*, arranged in coaxial alginment of similar design and dimension. Within the cylinders 12*a* and 12*b* there is disposed a pair of piston heads designated 14*a* and 14*b* supported for rectilinear displacement along a path having a common axis coincident with longitudinal axis of symmetry of cylinders 12*a* and 12*b*, designated $A_1$, FIG. 1.

It is important to appreciate that the piston heads 14*a* and 14*b* are of a generally free-floating design and are permitted to reciprocate within their respective cylinders. As a practical matter a suitable stop 16 of an annular configuration is provided within each of the cylinders for arresting retractive displacement of the piston heads 14*a* and 14*b*.

Each of the cylinders 12*a* and 12*b* is closed by a head 18 having defined therein an intake port 20 and an exhaust port 22. The port 20 is connected with a source of fluid, such as a cryogenic fluid or the like, via intake conduits designated 24 and 26 communicating through a suitable coupling 28 and a terminal portion 29 of the conduit 26. As a practical matter, the terminal portion 29 of the conduit 26 is concentrically related with an axis of rotation, designated $A_2$, normally related to the axis $A_1$, and serves as one stub axel for the cylinders 12*a* and 12*b*. While the details of the coupling 28 form no part of the claimed invention, it is to be understood that the coupling 28 is disposed within an hermetically sealed housing having a bearing block, not designated, through which is extended the portion 29. Moreover, the coupling 28 includes suitable intake or breather ports, or the like, arranged in a manner such that the conduit 24 is in continuous communication with the conduit 26, via the terminal portion 29 thereof, whereby the cylinders 12 and 12*b* continously communicate with a source of fluid via the conduit 24. Since the coupling 28 is driven at relatively slow speeds, no problems are normally encountered in transferring fluids therethrough. However, other suitable means for establishing communication between the conduits 24 and 26 are employed as desired.

Additionally, it is noted that within the conduit 26 there is provided a pair of one-way flow control valves designated 30*a* and 30*b* which, where so desired, comprise flapper valves. However, in practice, valves of any suitable design are employed equally as well.

Connected in communication with the exhaust ports 22 of the cylinders 12*a* and 12*b* there is an exhaust conduit 32, also having connected therein one-way flow control valves 33*a* and 33*b*. The cylinders 12*a* and 12*b* thus are connected in communication to a discharge orifice 34, via a terminal portion 36 of the conduit 32. Like the terminal portion 29 of the conduit 26, the terminal portion 36 is concentrically related with the axis $A_2$ and serves another stub axle for the cylinders. Where desired, a bearing block 38 serves to receive and support the terminal portion 36 of the conduit 32. Consequently, it should now be apparent that the cylinders are supported for rotation about the axis of rotation, designated $A_2$, by the terminal portions 29 and 36 of the conduits 26 and 32, respectively. Moreoever, the portions of the conduits 26 and 32 are further employed as axles for supporting the cylinders as they are driven in rotation.

In order to impart rotation to the cylinders 12*a* and 12*b* there is provided a suitable drive train, such as an electrical motor, designated 40. The motor 40 includes a rotary output shaft 42 connected with the coupling 28 by means of a stub shaft and suitable nipple 44. Suitable gearing is employed where so desired. In any event, it should now be apparent that the cylinders 12*a* and 12*b* are supported for rotation and are driven in angular displacement about the axis $A_2$ in response to an energization of the motor 40. As a practical matter, the motor 40 serves to accelerate and decelerate in a cyclic manner for reasons which will become apparent. It is, of course, apparent that where the motor 40 comprises a shunt motor running with fixed applied armature voltage and a variable field current, it is possible to vary the speed of the speed at which the cylinders 12*a* and 12*b* are rotated simply by switching the field current.

Of course, such rotation serves to force the piston heads 14*a* and *b* to advance outwardly along linear paths, away from the axis of rotation $A_2$, for purposes of exhausting or expelling charges of fluid from the cylinders through the exhaust valves 33*a* and 33*b* to the discharge orifice 34. Of course, means must be provided for retracting the piston heads in order to again charge the cylinders via the valves 30*a* and 30*b*.

As shown in FIG. 1 of the drawings, a tension spring 46, FIG. 2, is provided for this purpose. Consequently, it will be appreciated that forces applied to the piston heads 14*a* and 14*b*, in response to an acceleration of the cylinders 12*a* and 12*b* about the axis $A_2$, serves to drive the piston heads outwardly away from the axis of rotation, while the spring 46 serves to retract the piston heads for purposes of recharging the cylinders, as the cylinders are permitted to decelerate.

To exemplify a cycle of operation, reference first is made to FIG. 3. Assuming that the pistons are treated as point masses, there is a linear dependence of force on mass and radius, where $F=mRW^2$, F equals force, m equals mass, R equals radius and $W^2$ equals speed in rpm. Assuming each piston head comprises 1 kg piston arranged to have a minimum radius of 5 cm at 2000 rpm, point a, and a radius of 10 cm, relative to the axis $A_2$, at 2500 rpm, point b, the spring 46 is required to have a force of 225 kg at 2000 rpm, in order to retract the piston. The spring will have the restoring force of 450 kg when stretched to 10 cm. Since the centrifugal force in kg's at point b is around 700 kg, 250 kg is available against the fluid within the cylinder (700−450=250).

It should now be apparent that the compressor as hereinbefore described is particularly suitable for applications which require relatively low flow rates, whereby one or two strokes or cycles per second are adequate to achieve the desired flow rate.

Referring now to FIG. 4, wherein there is illustrated another embodiment of the invention, there is shown a compressor 50 of a somewhat more sophisticated configuration. It can be seen that as a practical matter, the compressor includes a pair of centrifugal-reciprocating compressor units 50*a* and 50*b*, each being similar in many respects to the compressor 10 hereinbefore described. As a practical matter, it is known from basic electrical machinery theory that during periods of deceleration, DC motors have a capacity to function as generators. Therefore, the compressor 50 is provided with a pair of motors, designated 52*a* and 52*b*, interconnected for alternate synchronized operation so that one motor functions as a generator while the other motor of the pair serves to accelerate a compressor-half connected thereto, as will hereinafter become more readily apparent, As shown, the compressor units 50*a* and 50*b* are encased within a common hermetically sealed housing 54. As a practical matter, the units 50*a* and 50*b* are of substantially the same construction and function in substantially the same manner to achieve substantially the same result. Accordingly, a detailed description of the compressor unit 50*a* is deemed adequate to provide for a complete understanding of the operation of the invention herein described and claimed.

The compressor unit 50*a* includes a pair of coaxially aligned cylinders 56 and 58 similar to the cylinders 12*a* and 12*b*, the cylinders being rotatable about an axis of rotation. Capping the cylinder 56 is a cylinder head 60 while a cylinder head 62 is provided for capping the outermost end of the cylinder 58. Within the cylinder head 60 there is provided a two-way port 64 while a two-way port 66 is provided within the cylinder head 62. Seated for rectilinear reciprocation within the cylinders 56 and 58 there is a pair of free-floating piston heads 68 and 70, similar in design and construction to the piston heads 14*a* and 14*b*, aforedescribed. The ports 64 and 66 of the cylinder heads 60 and 62, respectively, are connected with a valved manifold 72, via a tubular conduit 74 having a terminal portion 76. It is noted that the manifold 72, in practice, includes a union block, not designated, adapted to receive the terminal portion 76 and accommodate relative rotation thereof. It also is noted that the terminal portion 76 of the conduit 74 extends through a sealed bearing 78 to connect with the manifold 72. Thus the terminal portion 76 of the conduit 74 functions as a stub axle for supporting one side of the compressor unit 50 for rotation about an axis coincident with the axis of the stub axle formed by the terminal portion 76 of the conduit 74. The manifold 72, in turn, connects the terminal portioh 76 of the conduit 74 to a fluid inlet valve 80, and a discharge valve 82. Where so desired, flapper valves are employed for this purpose It is here noted that a shaft 84 is extended in coaxial alignment with the terminal portion 76 of the conduit 74 and is integrally related to a rotary output shaft 86 for the motor 52*a*. In practice, the shaft 84 is supported by a suitable bearing 88 mounted within the hermetically sealed housing 54. While not shown, it is to be understood that, where so desired, a nipple is provided for interconnecting the shaft 84 with the shaft 86, in a manner similar to that in which the nipple 44 is employed in connecting the shafts 29 and 42, aforementioned.

It is also important to appreciate that each of the pistons 68 and 70, at their innermost end faces, not designated, communicate with pressures established within the housing 54, via passages 90 suitably formed in the wall of the cylinders 56 and 58, in close proximity to the shaft 84. Additionally, it is to be understood that a suitable pump, designated 92, is employed for purposes of drawing-down a vacuum within the housing 54 and that the bearing race 78 comprises an hermetically sealed bearing in order to prevent passage of atmosphere therethrough.

Additionally, a control circuit, designated 94, is provided and connected to the motors 52*a* and 52*b* through suitable leads, for purposes of electrically interconnecting the motors.

Briefly, the control circuit 94 serves as a switching circuit for alternately applying electrical energy or voltage to the motors. Thus, when the supply of voltage is terminated to one of the motors, e.g., motor 52*a*, and is applied to motor 52*b*, the latter provides rotational motion to its shaft, thereby forcing the pistons outwardly, thus producing a compression stroke, i.e., fluid is forced out of the cylinders. As to motor 52*a*, upon the termination of the supply of voltage thereto, the shaft thereof does not come to a complete sudden stop. Rather, the shaft keeps turning, except at a continuously reduced speed, i.e., it decelerates. As it decelerates, the centrifugal forces decrease, enabling the pistons to start moving toward one another, i.e. retract, when the fluid pressure exceeds the centrifugal forces. As the pistons-retract, fluid flows into the cylinders, representing an intake stroke.

It is appreciated by those familiar with the art that when a shaft of a motor rotates without electrical energy being applied thereto, the motor acts as a generator. That is, the mechanical energy of the rotating shaft is converted to electrical energy, which is present across the motor's electrical terminals. In circuit 94, if desired, this electrical energy, produced by the motor, the shaft of which decelerates, thus acting as a generator, may be used, together with electrical energy from the main external source, to drive the other motor, thus resulting in a more efficient system.

The use of the electrical energy from a generator to drive to provide some of the electrical energy, necessary to drive a motor, is well known by any one familiar with the art of motors and generators, as well as by those familiar with devices, such as compressors, which require motors or the like for their operation. The prior art literature is replete with descriptions of such arrangements. See, for example, pages 207–210 in the bookentitled *Direct Current Machinery* by Koeffler et al., New York, the Macmillan Company, 1949, and pages 548–550 from the book *Principles of Direct-Current Machinery* by Alexander S. Langsdorf, McGraw-Hill Book Company, 1940.

From the foregoing, it should be appreciated that those familiar with the art of compressors of the type driven by electrical motors can easily implement the control circuit 94 to alternately drive each of motors 52*a* and 52*b*, e.g., 52*a* as a motor, and use the electrical energy, provided by the non-driven motor, e.g., 52*b*, which acts as a generator, together with the energy from the external source to drive motor 52*a*. The following description of a simplified embodiment of control circuit 94 is presented for explanatory purposes only, rather than to limit the invention thereto.

Figure 4A:
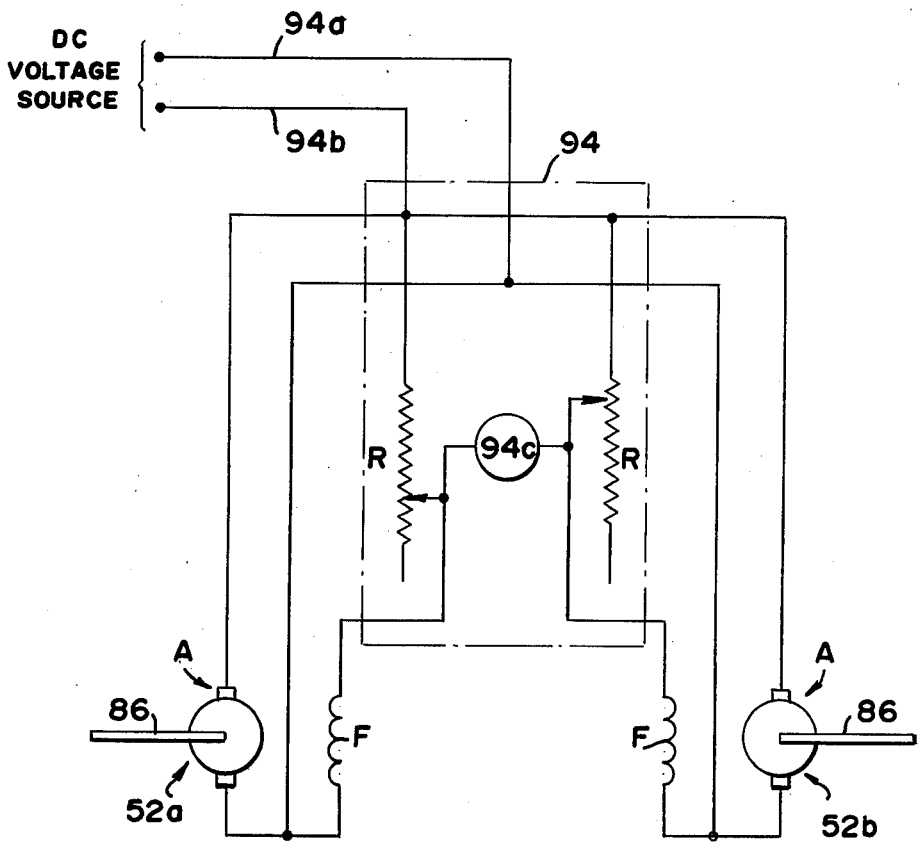
FIG. 4A is a simplified diagram of a control circuit 4, shown in FIG. 4.

Attention is now directed to FIG. 4A, wherein each of the motors 52*a* and 52*b* is shown in greater detail. As is appreciated, each of these motors, which is assumed to be a DC motor, includes an armature A and a field winding F. As shown in FIG. 4A in the control circuit 94, its leads 94*a* and 94*b*, which are connected to the external DC voltage source, are also connected to the motors' armatures A. Thus, the armatures are connected in parallel. Each of the field windings F is connected across a separate speed controlling rheostat R across the leads 94*a* and 94*b*. A clock drive 94*c* alternately controls the two rheostats R.

As is appreciated, when the field current through the field winding F of a DC motor is increased, power is delivered into the lines, i.e., the motor acts as a generator. On the other hand, when the field current is decreased, the generated voltage is reduced and power flows into the motor, i.e., the motor functions as a motor, to provide mechanical energy in the form of shaft rotation. In the present arrangement, the clock drive 94c drives the two Rheostats R, by increasing the resistance provided by one of these, thus decreasing the field current therethrough, and by decreasing the resistance provided by the other rheostat, thus increasing the field current therethrough. For example, to drive motor 52a as a motor, the resistance of its associated rheostat is increased by 94c; thus its field current decreases and it functions as a motor. At the same time, clock drive 94c decreases the resistance, provided by the rheostat R of motor 52b. Thus, its field current increases and therefore motor 52b functions as a generator. Its voltage-output across its armature A is combined with the external voltage to drive motor 52a. To alternate the operation, namely drive 52b as a motor and 52a as a generator, the resistances of the rheostats associated with them are decreased and increased respectively.

Again, it should be stressed that the implementation of the control circuit 94 as shown in FIG. 4A is for explanatory purposes only, and it is not intended to limit the invention thereto. Those familiar with the art may implement circuit 94 in different ways, without departing from the scope of the invention.

It should again be stressed that the invention is directed to the unique compressor and not the manner in which electrical power is applied to its motor 52a and 52b, to drive them alternately through circuit 94. Clearly, if desired, the two motors may be driven alternately during successive time periods by electrical energy only from the external source. The electrical energy, available from the non-driven motor, with the decelerating shaft, may be ignored. Also, it should be clear that if desired, the novel compressor may comprise only one-half of the arrangement shown in FIG. 4, e.g., the left half, with motor 52a. In such a case, it is clear that as long as the motor 52a is electrically driven, centrifugal forces are applied to the pistons 68 and 70, thus forcing them outwardly. The pistons are free to move radially outwardly with respect to the axis of rotation of the cylinders, and to remain in their radially outward positions under the force of centrifugul force during a plurality of rotations of the cylinder when the motor continues to rapidly rotate the cylinders for a plurality of rotations. Then, when the supply of electrical energy to the motor 52a is terminated, the shaft 84 decelerates, thus reducing the centrifugal forces, thereby enabling the pistons to retract and thereby producing the in-take stroke.

At this juncture, it also is important to appreciate that the spring 46, aforementioned, is omitted in the embodiment of FIG. 4, in view of the pressure differential operationally established across the piston heads 68 and 70, via the passages 90, during each cycle of operation thereof. For example, it can be appreciated that the pressures confined within the hermetically sealed housing 54 remain below the pressures existing within the conduits 74 so that the piston heads 68 are continuously subjected to backpressure. Thus, the piston heads are retracted as a consequence of a deceleration of the cylinders 56 and 58, coupled with the pressure differential established thereacross.

Figure 6:
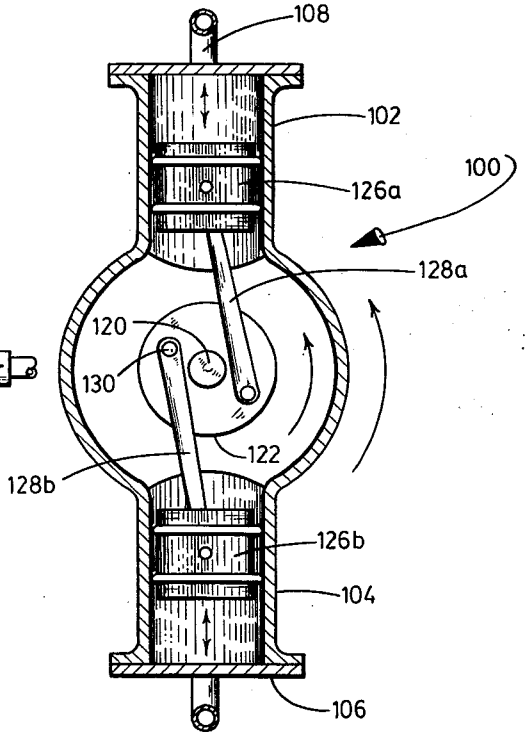
FIG. 6 is a sectional view taken generally along lines 6—6 of FIG. 5.
Figure 5:
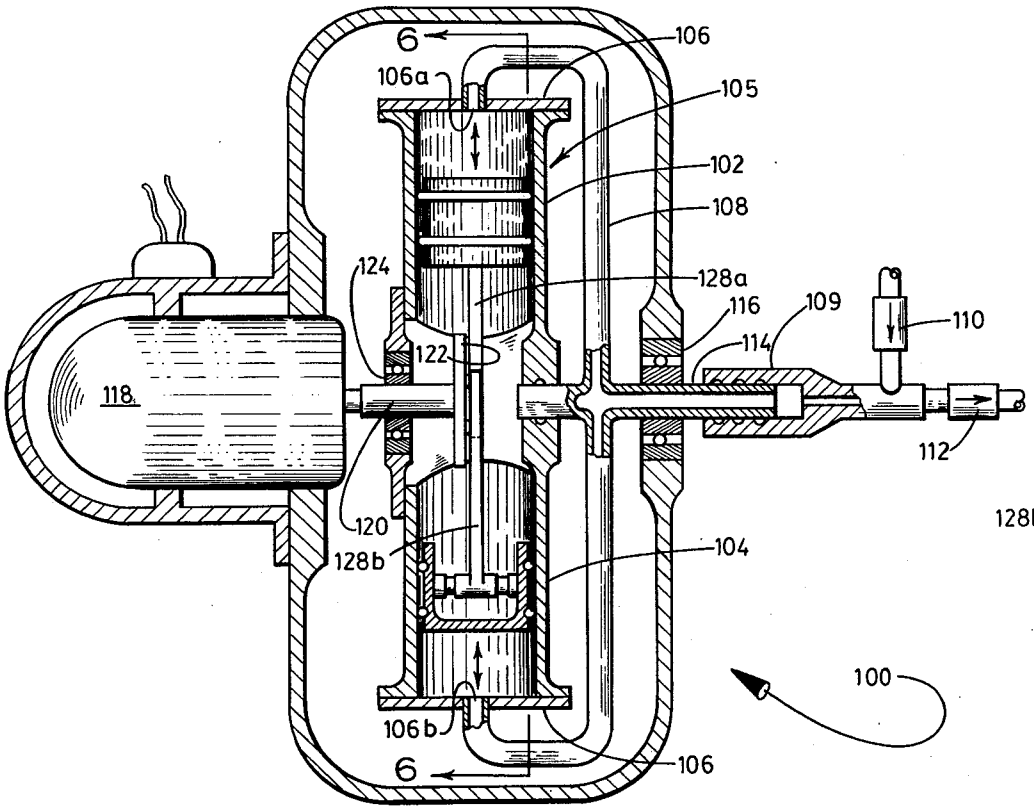
FIG. 5 is a cross sectional view of another embodiment of the invention.

Turning now to FIGS. 5 and 6, therein is illustrated a further embodiment of the invention, designated 100. The embodiment 100 is similar in many respects to the various embodiments aforedescribed.

As shown in FIGS. 5 and 6, the embodiment therein illustrated includes a pair of cylinders 102 and 104 having ported cylinder heads 106, which include ports 106a and 106b connected through an intercommunicative conduit 108 to a valved manifold 109. The cylinders are defined in a housing 105 and are connected to a valved manifold 109, provided with flow control valves 110 and 112, similar to the flow control valves 80 and 82 of the valved manifold 72. It is to be understood that the flow control valve 110 is connected with a source of fluid and accommodates passage of the fluid from the source into the conduit 108, ultimately to be delivered to the cylinders 102 and 104. Conversely, the flow control valve 112 is connected to a flow discharge and accommodates passage of fluid from the cylinders via the conduit 108.

The conduit 108, as shown, is provided with a terminal portion 114, similar in design and function to the terminal portion 76 of the conduit 74. The terminal postion 114 is concentrically related with an axis of rotation bisecting the longitudinal axis of symmetry, not designated, for the cylinders 102 and 104 and serves as a stub axle for supporting the cylinders at one side thereof for angular displacement about the axis of rotation.

Mounted on the housing which defines the enclosure 105 there is a motor 118. This motor comprises an electrically energizable motor having a rotary output shaft 120. To the terminal end portion of the shaft 120 there is fixed an eccentric, which for the sake of convenience is referred to as a flywheel, designated 122. In practice, the eccentric functions as a crankshaft rather than a flywheel in the true sense of the word, as will become apparent. The output shaft 120 also is extended through an annular bearing 124 affixed to the housing for cylinders 102 and 104, in coaxial alignment with the bearing 116. Consequently, it can be appreciated that the shaft 120 not only draws the flywheel 122 but serves as a stub axle for supporting the cylinders for rotation about the axis thereof.

Within the pair of cylinders 102 and 102, there is disposed a pair of piston heads 126a and 126b adapted to advance outwardly. It also should be noted that the piston head 126a is connected with the flywheel 122, via a connecting rod 128a, while the piston head 126b is connected with the flywheel 122 via a connecting rod 128b. In practice, the connecting rods 128a and 128b are connected through suitable wrist pins to the piston heads 126a and 126b and bearing pins, not designated, to the fly wheel 122, whereby rotation of the flywheel is converted to linear motion imparted to the piston heads.

Additionally, it is important to understand that the connecting rods 128a and 128b are of a length such that they are "too long" to be positioned in coaxial alignment with the piston to which they are connected. In other words, the length of the connecting rods 128a and 128b is such that the piston heads 126a and 126b reach top dead center before axial alignment of the connecting rods with the cylinders is achieved. Therefore, as rotary motion is imparted to the flywheel 122, in response to the motor 118 being energized and caused to act thereon through the shaft 120, the housing 105 is caused to rotate and to gather momentum in a manner consistent with that of a conventional flywheel.

Of course, once the motor 18 is switched "off", the momentum acquired by the housing 105 causes the housing to continue to rotate while the piston heads 126a and 126b are restrained against concurrent rotation by the motor 118 for thus causing the piston heads to retract relative to the cylinders 102 and 104. Therefore, it thus becomes possible for the rates of rotation for the housing 105 and the flywheel 122 to have instantaneous differences but equal average values whereby reciprocation is imparted to the piston heads.

In operation, the motor 118 is energized for driving the flywheel 122. As the flywheel 122 is responsively driven in rotation, the piston heads 126a and 126b are advanced outwardly toward the cylinder heads 106, until such time as the piston heads approach a top dead center position relative to the cylinders 104 and 106. Rotating force now is transmitted from the shaft 120 to the housing 105, via the connecting rods 128a and 128b, for thus imparting angular momentum to the housing 105. As the housing 105 thus is caused to attain a selected rate of rotation, the motor 118 is switched "off", whereupon the rate of rotation of the flywheel 122 lags, relative to the rate of rotation of the housing 105, resulting from the angular momentum thereof. The instantaneous differences in the rates of rotation for the flywheel 122 and the housing 125 causes the pistons 126a and 126b to retract for thus charging the end portions of the cylinders 104, via the valve 110.

Of course, once the motor 118 is again energized, the piston heads are forced outwardly on compression strokes for discharging fluid from the cylinders via the conduits 108 and angular momentum again is imparted to the housing 105. This intermittent cyclic operation can be continued as desired with minimal compressive loading of the connecting rods due to the forces applied to the piston heads in response to rotary motion of the housing 105. In other words, once momentum is imparted to the housing 105, compressive loading of the connecting rods 128a and 128b is minimized.

Figure 8:
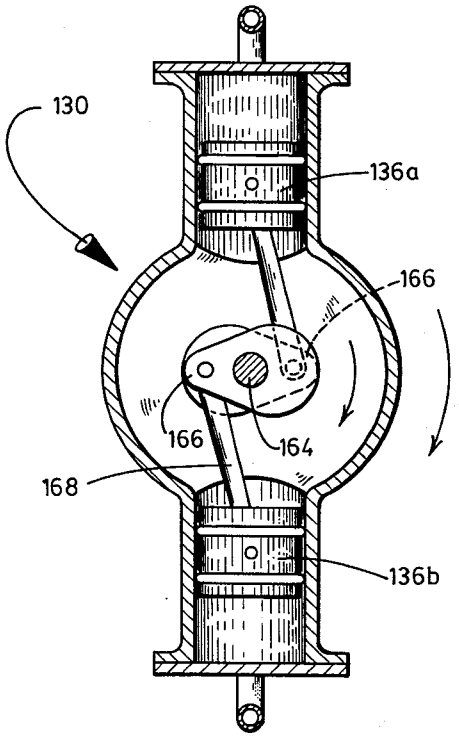
FIG. 8 is a sectional view taken along lines 8—8 of FIG. 7.
Figure 7:
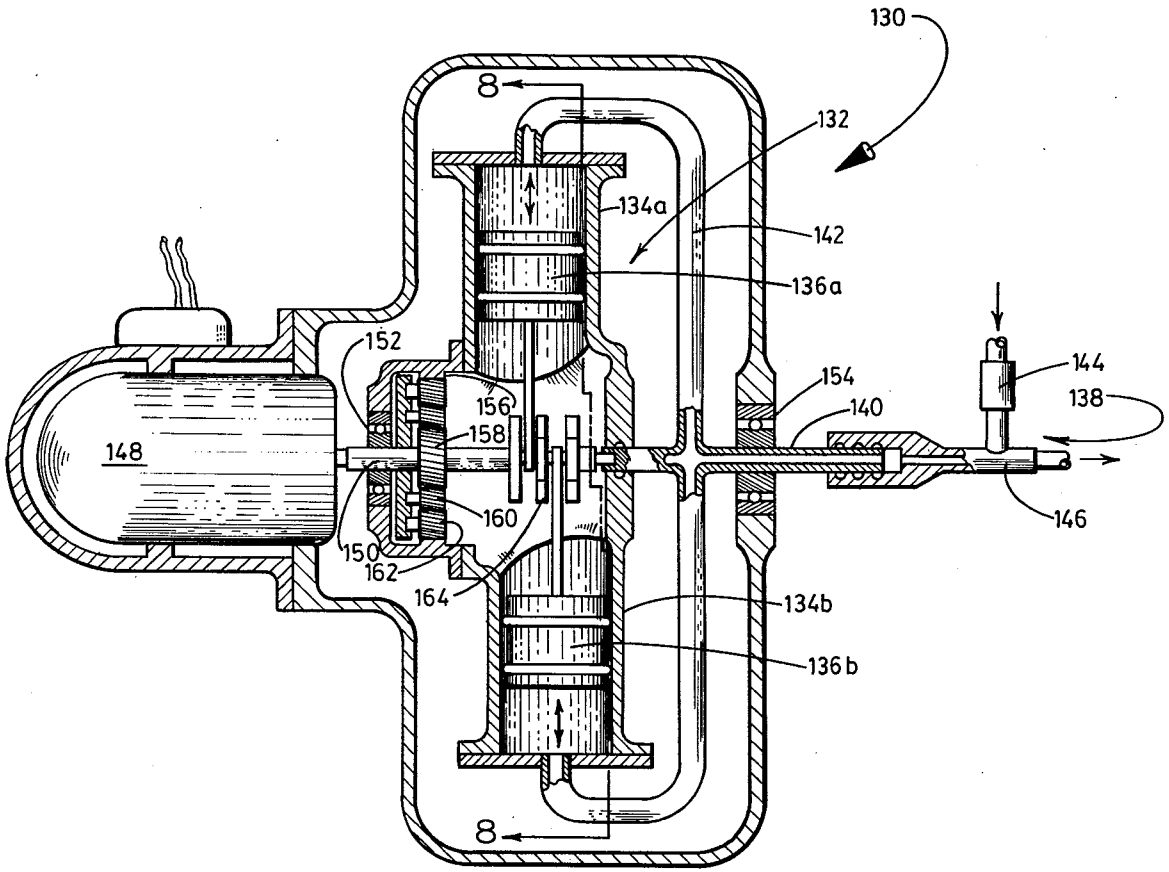
FIG. 7 is a cross sectional view of still another embodiment of the invention.

A further embodiment of the invention, herein designated 130, is illustrated in FIGS. 7 and 8. The further embodiment 130 is, in many respects, similar to the embodiment shown in FIGS. 5 and 6. However, it is important to note that the embodiment 130 includes a rotary housing 132 having defined therein cylinders 134a and 134b within which is disposed piston heads 136a and 136b. The cylinders 134a and 134b communicate with a valved manifold 138 which is similar in design and function to the valved manifold 109, through a terminal portion 140 of a conduit 142.

The conduit 142 and the terminal portion 140 are similar to the conduit 108 and its terminal portion 114, aforedescribed. Further, like the valved manifold 109, the valved manifold 138 includes flow control valves 144 and 146 adapted to function in a manner similar to that in which the valves 110 and 112 are adapted to function. Therefore, a detailed description of the manifold 109 is omitted in the interest of brevity.

A motor 148 having an output shaft 150 is provided for driving the housing 132 in angular displacement, about an axis of rotation coincident with the axes of the terminal portion 140 of the conduit 142 and the output shaft 150. As a practical matter, coaxially aligned bearings 152 and 154 are concentrically related to the terminal portion 140 and the shaft 150 and are provided for supporting the housing 132 for angular displacement.

It is, at this juncture, important to note that within the housing 132 there is provided a ring gear 156, while a sun gear 158 is affixed to the shaft 150. Planetary gears 160 and 162 are provided in intermeshed relation therewith. Hence, the housing 132 is driven in rotation in response to a driven rotation of the sun gear 158.

It also is important to note that the output shaft 150 extends to terminate in a crankshaft 164 and, of course, serves to impart rotation thereto simultaneously with the rotation imparted to the housing 132 via the sun gear 158. The crankshaft 164 includes suitable crank arms 166 which are connected to the piston heads 136a and 136b through suitable connecting rods 168. In practice, the connecting rods 168 are connected with the crank arms 166 via suitable bearing pins, not designated, and to the piston heads 136a and 136b employing suitable wrist pins, also not designated.

Attention is kindly invited to the fact that the length of each of the connecting rods 168 is such as to accommodate 360 degrees of rotation of the crankshaft 164 relative to the housing 132. In other words, the crankshaft 164 and the housing 132 are so related that both the housing and the crankshaft may be driven in concurrent rotation but at different rates, and in common directions.

In practice, the rates of rotation are constant so that constant stroking rate for the pistons is achieved. For example, assuming that the housing 132 is driven at a constant rate of 1800 rpm and the crankshaft 164 is driven at a constant rate of 1700 rpm, in the same direction as the housing, the difference in rates equals 100 rpm which converts to 100 strokes per minute for the pistons. The principal advantage here acheived is that the stresses in the reciprocating members may be reduced considerably simply by choosing suitable operating speeds for a given set of operating pressures.

In operation, the motor 148 is energized, whereupon the drive shaft 150 acts on the housing 132 and the crankshaft 164, concurrently, for simultaneously imparting angular displacement thereto at constant but different rates. Thus, the piston heads are caused to reciprocate in intake and compressive strokes at a constant rate. Fluid is then introduced into and discharged from the cylinders.

In summary, by accommodating rotation of the housing for the pistons, for each of the aforementioned embodiments, centrifugal forces are caused to act on the pistons and these forces are made available for purposes of compressing fluids within the cylinders. Since large amounts of kinetic energy can be stored in rotating masses, it is possible, by rotating the compressors, to reduce the bulk and weight of component parts thereof for thereby improving efficiency in the operation thereof. Moreover, the particular choice of configuration employed will, in practice, be dictated at least in part by the working pressure and flow rates desired for selected operations.

What is claimed is:

1. A centrifugal compressor for periodically compressing a charge of fluid comprising:

a cylinder supported for rotation about a fixed axis of rotation which is transverse to the longitudinal axis of the cylinder, said cylinder being supported in fixed relation with said axis of rotation;

means including a vent valve to supply fluid to the cylinder during an intake stroke and including an outlet valve to remove fluid from said cylinder during a compressing stroke;

a free-floating piston head seated in the cylinder and supported for rectilinear displacement along a path normal to said axis of rotation; and means for reciprocating said piston head within said cylinder including motion producing means for imparting an intake stroke to the head, and for imparting a compression stroke to the head, said motion producing means comprising selectively operable drive means connected in driving relation with the cylinder for imparting angular displacement to the cylinder.

2. A centrifugal compressor as defined in claim 1 wherein said motion producing means for imparting an intake stroke to said piston head includes means for urging the piston head toward said axis of rotation.

3. A centrifugal compressor as defined in claim 2 wherein said motion producing means for imparting an intake stroke to said piston head includes means for establishing a pressure differential across the piston head.

4. A centrifugal compressor as defined in claim 3 wherein said drive means for imparting angular displacement to the cylinder includes an electrically energizable motor for imparting cyclic angular acceleration to said cylinder.

5. A centrifugal compressor as defined in claim 3 wherein said piston head includes a pair of opposed faces and said means for establishing a pressure differential across said piston head includes means for simultaneously subjecting the opposite faces of said piston head to pressures of different magnitudes.

6. A centrifugal compressor as defined in claim 5 wherein a first face of the pair of faces serves to force fluid from the cylinder against a first pressure, and a second face of the pair is continuously subjected to a second pressure of a value less than half of the first pressure.

7. A centrifugal compressor as defined in claim 6 wherein said cylinder is disposed in an hermetically sealed chamber maintained at a third pressure having a value substantially equal to that of the second pressure and said cylinder defines an opening whereby the second face of said piston head is exposed to the second pressure in said chamber.

8. A centrifugal compressor comprising:

a first and second compressor unit, each unit being characterized by a pair of cylinders arranged in coaxial alignment and characterized by a pair of mutually remote ends and a pair of mutually spaced adjacent ends and a common longitudinal axis of symmetry extended between the remote ends of the pair of cylinders;

means supporting said pair of cylinders for rotation about a common axis normally bisecting said longitudinal axis of symmetry and means defining ported closures for the mutually remote ends of the pair of cylinders;

a pair of piston heads, each piston being disposed in one cylinder of said pair of cylinders and supported thereby for free-floating displacement along a linear path having an axis coincident with a segment of said longitudinal axis of symmetry;

means for periodically forcing said piston heads to advance toward the ported closures of the cylinders for forcing fluid from the ported closures under a discharge pressure including a variable speed DC motor characterized by an armature and field windings and connected in driving relation with said pair of cylinders;

means connected with the field windings for each motor for establishing therein a field current and circuit means electrically interconnecting the motors for switching the field current between the field windings of the motors for alternately accelerating and decelerating the armatures thereof, whereby each motor of the pair alternately functions as a motor and as a generator; and means for periodically retracting pistons along said path toward said axis of rotation including means for establishing a pressure differential across said piston head for each pair of piston heads.

9. A centrifugal compressor as defined in claim 8 wherein said means for establishing a pressure differential across the piston heads includes means defining an hermetically sealed chamber confining said compressor and communicating with each of the cylinders and maintained at a pressure less than the discharge pressure.

10. A centrifugal compressor for periodically compressing a charge of fluid comprising:

a cylinder having opposite ends, said cylinder being supported for angular motion about an axis of rotation;

valve means coupled at one end of the cylinder for introducing fluid into the cylinder and for discharging fluid from the cylinder;

a free-floating piston head having a pair of opposed faces seated in the cylinder and supported thereby for reciprocating displacement along a path that is transverse to said axis of rotation; and means imparting to said piston head an intake stroke including means for continuously subjecting the opposite faces of said piston to fluid pressures of different magnitudes for thereby causing said piston head to retract relative to said one end for charging said cylinder through said valve means, and means for imparting to said piston head a discharge stroke including selectively operable drive means connected to said cylinder for imparting thereto angular displacement about said axis of rotation, whereby centrifugal force is applied to said piston head for causing the piston head to advance relative to said one end for forcing fluid from the cylinder through said valve means.

11. A centrifugal compressor for compressing fluid, comprising:

a cylinder having a longitudinal axis and rotatable about an axis of rotation;

a first piston moveable within said cylinder in either a first direction along said longitudinal axis toward a radially inward position during an intake stroke or in a second direction, opposite said first direction and towards a radially outward position, during a compression stroke;

fluid conduit means for providing a flow path for fluid into said cylinder during an intake stroke and, for providing a flow path for the fluid out of said cylinder during a compression stroke;

first means for applying forces to said piston to urge it to move in said first direction, whereby fluid flows into said cylinder, representing the intake stroke; and energizable drive means for rapidly rotating said cylinder by a plurality of complete turns about said rotation axis for imparting centrifugal forces to said piston so that the piston moves in said second direction to thereby force fluid out of said cylinder, representing said compression stroke, with said centrifugal forces decreasing upon the deenergization of said drive means, whereby when the forces applied to said piston by said first means exceed said centrifugal forces said piston moves in said first direction;

said piston being free to move in said second direction and remain in said radially outward position during a plurality of rotations of said cylinder under the force of said centrifugal forces.

12. A centrifugal compressor as defined in claim 11 wherein said energizable drive means comprises a periodically energizable motor having a rotatable shaft extending in a preselected direction, and means for coupling said cylinder to said shaft whereby the longitudinal axis of said cylinder is transverse to the shaft's preselected direction.

13. A centrifugal compressor for compressing fluid comprising:

a cylinder having a longitudinal axis and rotatable about an axis of rotation perpendicualr to said longitudinal axis;

first and second pistons moveable along said longitudinal axis within said cylinder in either radially inward directions with respect to said axis of rotation, wherein they move toward each other, during an intake stroke or in radially outward directions, opposite said first directions, during a compression stroke;

fluid conduit means for providing a flow path for fluid into said cylinder during an intake stroke, and for providing a flow path for the fluid out of said cylinder during a compression stroke;

first means for applying forces to said pistons to urge them toward each other, whereby fluid flows into said cylinder, representing the intake stroke; and a periodically energizable motor having a rotatable shaft coupled to said cylinder to rotate it about said axis of rotation to impart centrifugal forces to said pistons so that the pistons move in said radially outward directions to thereby force fluid out of said cylinder, representing said compression stroke, with said centrifugal forces decreasing upon the deenergization of said motor, whereby when the forces applied to said pistons by said first means exceed said centrifugal forces said pistons move in said radially inward directions.

14. A centrifugal compressor as defined in claim 13 wherein said first means include coupling means for coupling said pistons to one another to retract them toward one another when the forces of said first means, applied to said pistons, exceed said centrifugal forces.

15. A centrifugal compressor as defined in claim 14 wherin said coupling means comprises spring means.

16. A centrifugal compressor as defined in claim 14 wherein said coupling means include a rotatable crankshaft and rods extendable therefrom and having ends coupled to said pistons for urging said pistons to retract.

17. A centrifugal compressor as defined in claim 13 wherein each of said pistons includes first and second opposite faces, with the first faces of said pistons pointing toward one another and the second faces thereof being exposed to the fluid in said cylinder which is at a first pressure value other than during a compression stroke, and said first means include means for providing a second pressure value in the cylinder space between the first faces of said pistons, to produce a pressure differential across each piston, sufficient to urge said pistons to retract toward one another when the centrifugal forces are less than a preselected value.

* * * * *